US005645435A

United States Patent [19]

Cimino et al.

[11] Patent Number: 5,645,435

[45] Date of Patent: Jul. 8, 1997

[54] ELECTRICAL CONNECTOR

[75] Inventors: Nicholas Robert Cimino, Camp Hill; Phillip Mark Fortney, Harrisburg, both of Pa.

[73] Assignee: The Whitaker Corporation, Wilmington, Del.

[21] Appl. No.: 510,452

[22] Filed: Aug. 2, 1995

[51] Int. Cl.[6] ..... H01R 13/648

[52] U.S. Cl. ..... 439/92; 439/95; 439/376

[58] Field of Search ..... 439/95, 928, 108, 439/92, 660, 376, 855

[56] References Cited

U.S. PATENT DOCUMENTS

| | | | |
|---|---|---|---|
| 3,174,028 | 3/1965 | Ammerman | 219/455 |
| 4,109,992 | 8/1978 | Hughes et al. | 339/147 R |
| 4,117,310 | 9/1978 | Clark | 219/451 |
| 4,176,903 | 12/1979 | Cairo et al. | 339/147 R |
| 4,711,506 | 12/1987 | Tanaka | 439/108 |
| 4,732,568 | 3/1988 | Hall | 439/676 |
| 4,740,173 | 4/1988 | Justiano et al. | 439/351 |
| 4,906,208 | 3/1990 | Nakamura et al. | 439/67 |
| 5,092,790 | 3/1992 | Justiano et al. | 439/351 |
| 5,207,603 | 5/1993 | Peloza | 439/884 |
| 5,221,212 | 6/1993 | Davis | 439/108 |
| 5,304,069 | 4/1994 | Brunker et al. | 439/108 |
| 5,356,313 | 10/1994 | Niwa et al. | 439/607 |

*Primary Examiner*—Neil Abrams
*Assistant Examiner*—Eugene G. Byrd

[57] ABSTRACT

The invention comprises an electrical connector having a housing. The housing has a top, a front, a back, and a contact receiving cavity extending from the back to the front of the housing and being open along the top. A guide rail extends along a top portion of the contact receiving cavity. A contact is disposed within the contact receiving cavity and has a contact section which is accessible from the top of the connector. A grounding member is disposed around the housing and has a connection section for making ground connection with a matable connector and has a mounting section for mounting the connector. The guide rail guides the matable contact into correct position for proper mating with the contact.

15 Claims, 4 Drawing Sheets

ELECTRICAL CONNECTOR

FIELD OF THE INVENTION

The invention relates to an electrical connector, and more specifically to an electrical connector for a stove top.

BACKGROUND OF THE INVENTION

An electrical stove typically has an electrical connector along the underside of the stove top to provide electrical connection to the surface burners. The stove top has circular openings into which the surface burners are mounted. The connector is disposed along the edge of the circular area and has a grounding member which is disposed around a housing. Contacts are disposed within the housing in contact receiving channels. The leads from the surface burner are ring shaped and fit within the contact receiving channel and in electrical contact with the contacts to provide electrical connection to the surface burner. The grounding member has tabs which extend forwardly from the housing to provide electrical connection to the ground on the surface burner. The ground plate also has a mounting portion which secures the connector to the stove top and provides a ground connection between the connector and the stove top. The surface burner has a ground contact portion. When the surface burner is mated with the connector, the ground contact portion of the surface burner comes into electrical contact with the ground plate prior to the ring shaped leads coming into electrical contact with the contacts. This is a safety feature which protects the user of the stove.

The connector is mounted below the stove top, so mating of the burner with the connector is done blindly. The typical user of the connector has no indication of how the leads of the surface burner should be inserted into the connector, nor is there an indication of how far into the connector the leads should be inserted. There is no indication that the burner is completely mated. Another problem that exists is that at times the surface burner does not seat property resulting in a tilted burner which can also rattle.

It would be an advantage to have an electrical connector that ensures proper mating. It would be an advantage to have a connector which has a guide member to guide the leads into correct alignment, a stop member to make sure the leads are inserted at the proper position, and a top mounting connector in which the user can see if the burner is properly inserted.

SUMMARY OF THE INVENTION

The invention comprises an electrical connector having a housing. The housing has a top, a front, a back, and a contact receiving cavity extending from the back to the front of the housing and being open along the top. A guide rail extends along a top portion of the contact receiving cavity. A contact is disposed within the contact receiving cavity and has a contact section which is accessible from the top of the connector. A grounding member is disposed around the housing and has a connection section for making ground connection with a matable connector and has a mounting section for mounting the connector. The guide rail guides the matable contact into correct position for proper mating with the contact.

The invention further including a contact for an electrical connector, the contact having a main body extending in a longitudinal direction. The main body has a crimping section and a contact section. The contact section has a front end, a back end, and a top end. The contact section is generally U-shaped and having a base with generally parallel walls upstanding from the base. The upstanding walls have outwardly angled sections along the top end of the contact section to receive a matable contact therebetween and to guide the matable contact into connection with the parallel walls.

BRIEF DESCRIPTION OF THE DRAWINGS

An embodiment of the present invention will be described by way of example with reference to the accompanying drawings, in which.

DETAILED DESCRIPTION OF THE INVENTION

Figure 3:
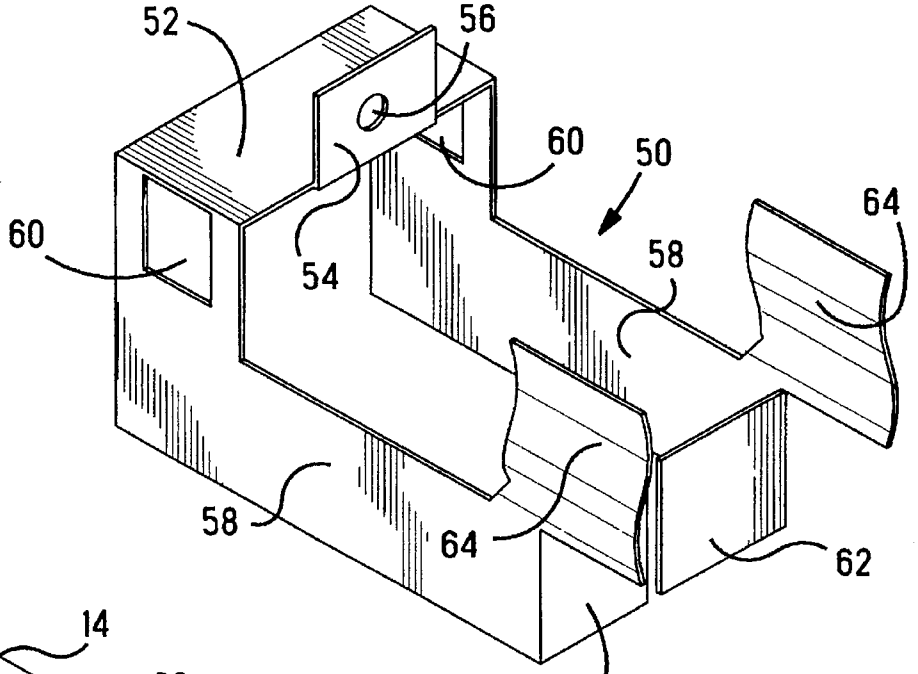
FIG. 3 is an isometric view of the ground member.
Figure 1:
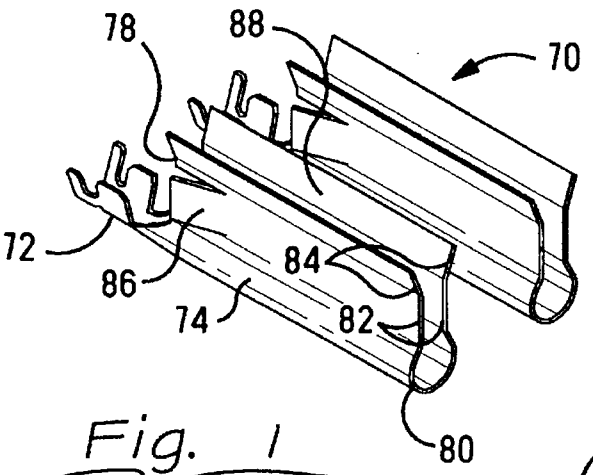
FIG. 1 is an isometric view of the contact of the present invention.
Figure 2:
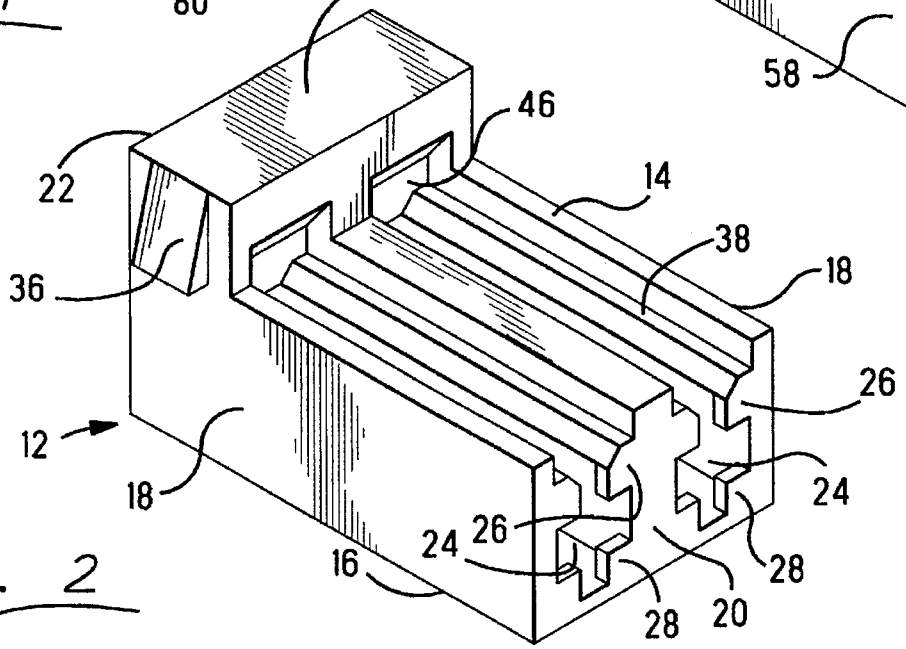
FIG. 2 is an isometric view of the connector housing.
Figure 4:
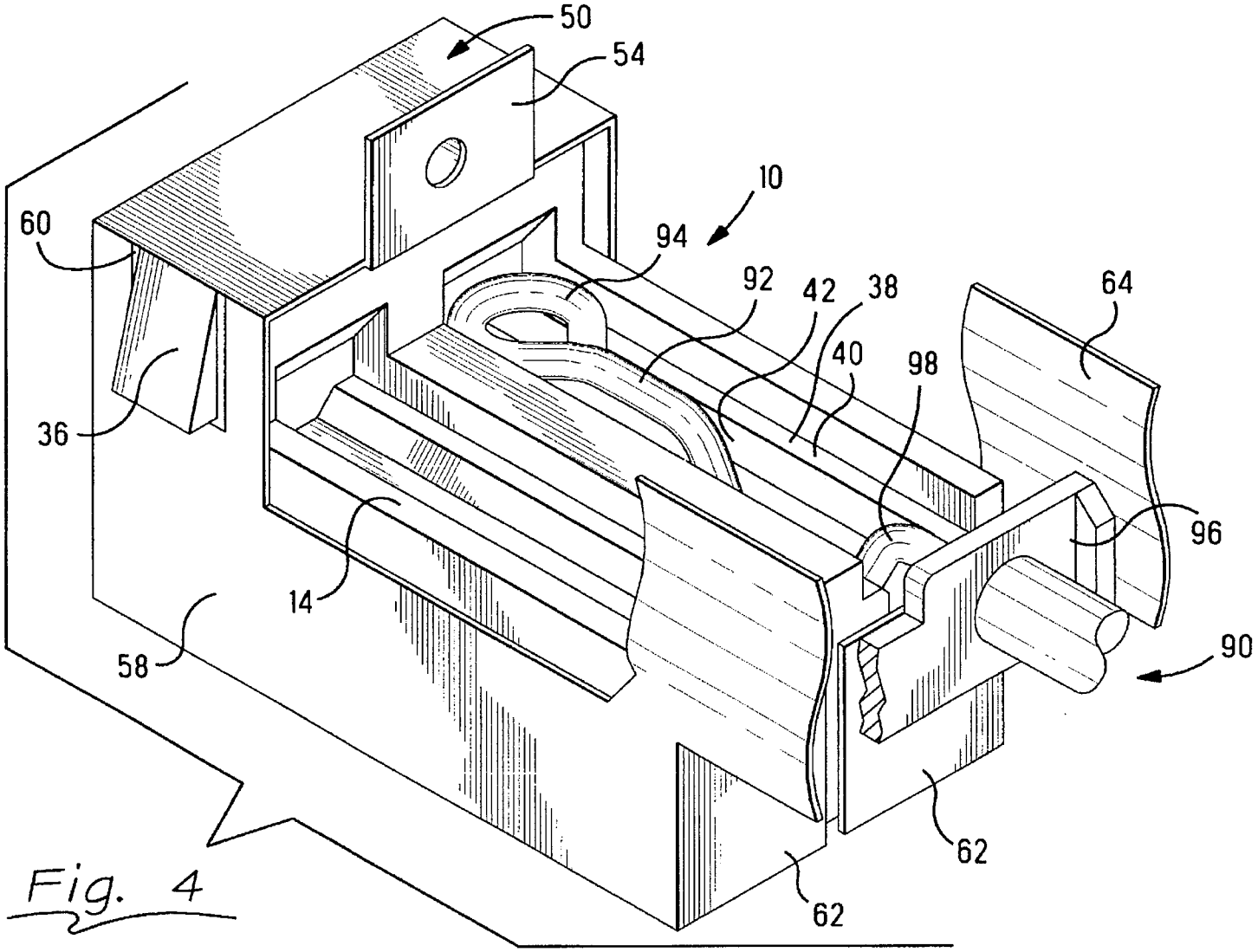
FIG. 4 is an isometric view of the connector fully assembled with a surface burner lead contact.

FIGS. 1, 2 and 3 show the components of the connector of the present invention. The connector comprises a housing 12, a ground member such as a ground cover 50, and contacts 70 which are to be disposed within the housing. FIG. 4 shows the connector 10 fully assembled. The connector is mounted on the underside of the stove top to provide electrical connection to a surface burner.

FIG. 2 shows the housing 12 which has a top 14, a bottom 16, side walls 18, a front 20, and a back 22. Two contact receiving cavities 24 extend longitudinally from the back 22 to the front 20 of the housing. While the specific embodiment has two contact receiving cavities, the connector of the present invention could have any number of cavities to receive contacts therein. Along the front 20, the contact receiving cavities 24 have stops 26, 28 which prevent the contacts from being pushed out the front of the housing.

Figure 8:
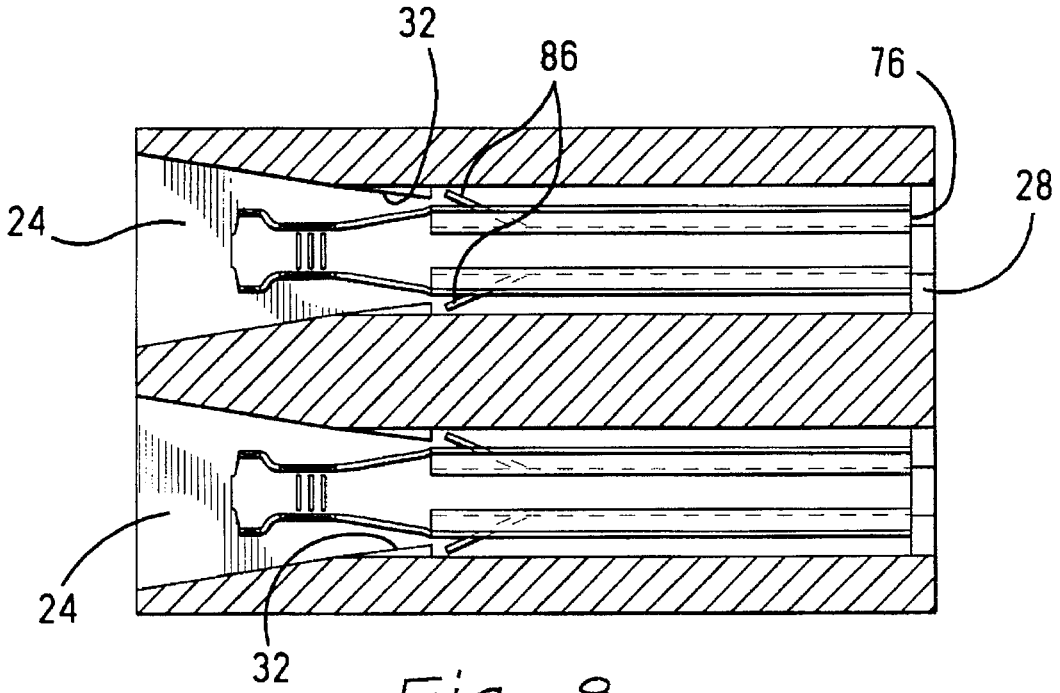
FIG. 8 is a cross sectional of the connector showing the contact in the contact receiving passages.
Figure 9:
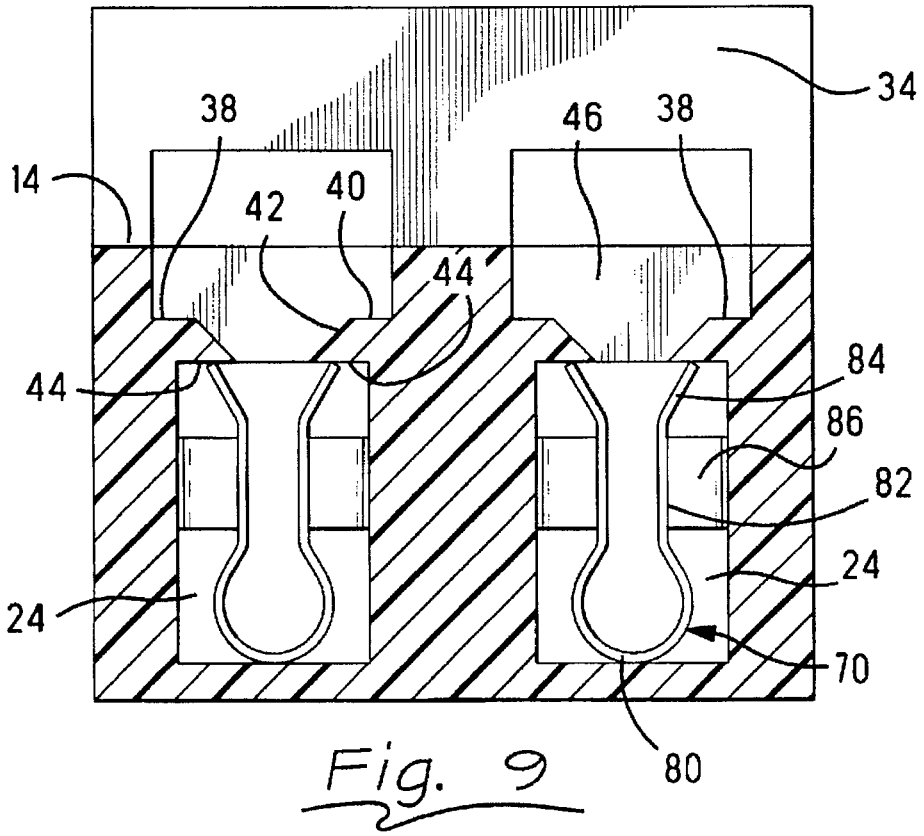
FIG. 9 is a cross sectional showing the contact in the contact receiving passages.

FIGS. 8 and 9 show the interior of the contact receiving cavities 24. The cavities 24 each have two latching surfaces 32 along either side wall. The latching surfaces 32 are used to secure the contact within the cavity 24.

The contact receiving cavities 24 are generally rectangular shaped and are open to the top 14 from the front 20 to the mounting portion 34, see FIG. 9. Along the top of the cavities 24 are guide rails 38. Each guide rail 38 includes a flat portion 40, a lead-in, angled portion 42, and a flat, bottom portion 44. The angled portions 42 are angled towards each other to form a guide into the contact receiving cavities 24. The guide rails 38 extend from the stops 28, along the front of the housing, back to mounting portion 34. Along the mounting portion 34, there are stops 46 which are used to stop the burner lead-ins. The stops 46 are recesses into the mounting portion 34 which are in alignment with the guide rails 38, see FIG. 2.

The housing 12 has a mounting portion 34 which extends upwardly from the top 14 of the housing 12 along the back 22. The mounting portion 34 has two latching surfaces 36 which extend from the side walls 18, one of the latching surfaces 36 being on the opposite side wall and not shown in the drawing.

The connector further has a ground cover 50 which is secured over the housing 12, see FIG. 3. The ground cover 50 has a top portion 52 which is secured over the mounting portion 34. A tab 54 extends upwardly from the top portion 52 to provide a means of mounting the connector to the stove top and to provide a ground connection to the stove top. The tab 54 has a screw hole 56. The cover 50 further has side walls 58 which extend downwardly and forwardly from the top portion 52. Openings 60 are used to secure the cover 50 to the housing 12. The cover 50 has front tabs 62 which are bent at right angles from the side walls 58. Wings 64 extend upwardly from the sidewalls 58, are resilient, and have curved contact sections.

Contacts 70 have a crimping portion 72 and a mating portion 74, see FIG. 1. The crimping portion 72 has upstanding legs which are used to crimp around a wire. The mating portion 74 extends in the longitudinal direction and has a front end 76 and a rear end 78. The mating portion 74 is generally U-shaped and has a rounded bottom portion 80, substantially parallel walls 82 extending upwardly from the bottom portion 80, and angled, lead-in portions 84. The lead-in portions 84 are angled outwardly from each other. The upwardly extending walls of the contact 70 define a contact recess 88 therebetween for receiving a matable contact. The recess 88 extends longitudinally along the length of the contact 70. The contact 70 has two resilient fingers 86 which extend outwardly from the generally U-shaped section, only one of which is shown in FIG. 1. The fingers 86 are along the rear 78 of the mating portion 74.

The ground cover 50 is secured over the housing 12, see FIG. 4. The top portion 52 fits over the mounting portion 34. Latching surfaces 36 are received through openings 60 to secure the cover 50 on the housing. The front tabs 62 fit over the front 20 of the housing and the wings 64 extend above the top 14 of the housing 12 along the front of the housing.

The contacts 70 are crimped to a wire and are then inserted into cavities 24 from the back 22 of the housing. The resilient fingers 86 are pushed past the latching surfaces 32 to secure the contact 50 within the cavity, see FIG. 8. The resilient fingers 86 are snapped past the front of the latching surface thereby preventing the contacts 70 from being pulled backwards out of the housing. The stops 26, 28 prevent the contact 70 from moving out the front 20 of the housing. The top of the contacts 50 are received adjacent to the bottom 44 of the guide rail 38, see FIG. 9. The guide rail prevents the contact from moving upwards, through the top 14 of the housing.

The connector 10 is mounted to the bottom of a stove top using the tab 54. The tab 54 is secured to the edge of the circle in which an electric burner is mounted. The mounting portion 34 is received below the stove top and the front 20 extends into the circular area for the burner.

A typical electric burner 90 has two central lead-in contacts 92 which provide electrical contact to internal resistance coils, only one of which is shown in FIG. 4. Each lead-in contact 92 has a ring 94 along the forward end of the contact. The contact 92 further has a V-shaped portion 98 which extends downwardly, see FIG. 5. The burner 90 further has a ground contact member 96. The ground contact member 96 is a round portion that encircles the lead-in contact 92 and from which the lead-in contact 92 extends.

Figure 6:
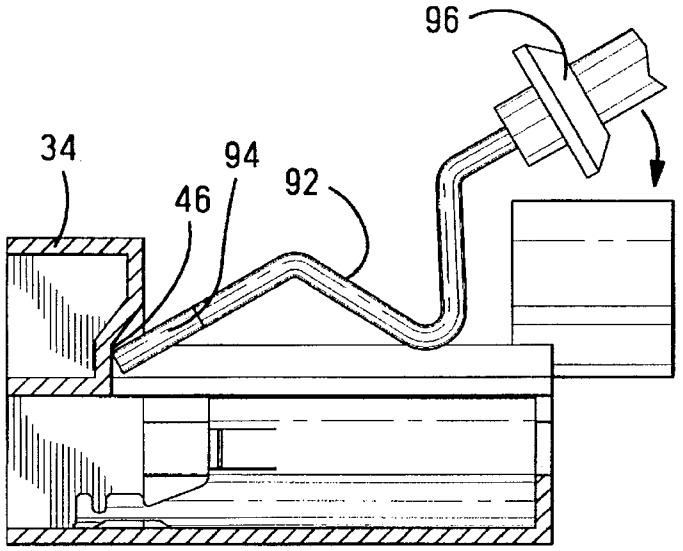
FIGS. 5, 6, and 7 is a cross sectional view showing the method of insertion of the surface burner lead-in into the connector.
Figure 5:
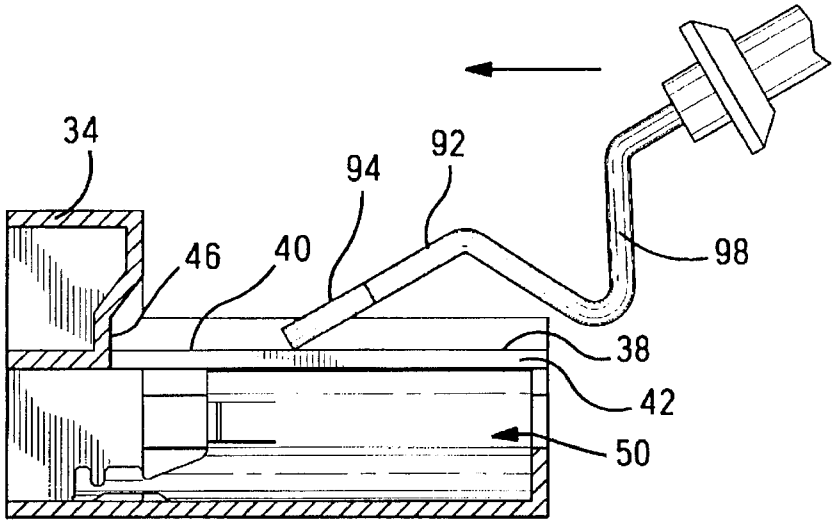
Figure 7:
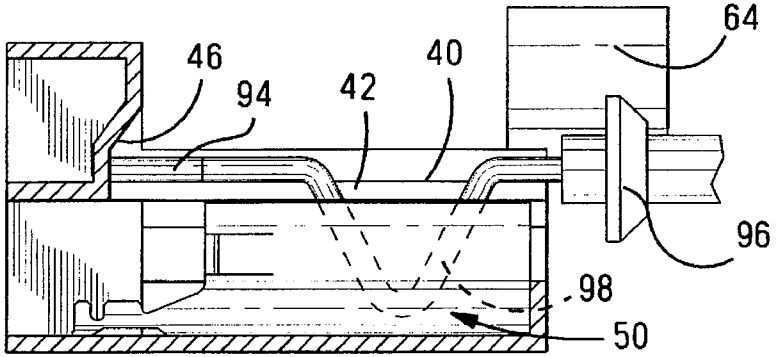

FIGS. 5, 6 and 7 illustrate the connection of the burner to the connector 10. The lead-in contact 92 is brought in at an angle to the guide rails 38. The ring 94 engages the top, flat surface 40 of the guide rails. The guide rails 38 prevent the ring 94 from moving into the contact receiving cavity and prevents the lead-in contact 92 from coming into electrical contact with contact 50 prematurely. The ring 94 is then pushed along the guide rails 38 until the ring 94 hits the stop 46, see FIG. 6. The burner is then rotated downward such that the ground contact member 96 comes first into contact with wings 64.

The V-shaped portion 98 is guided between the lead-in portions 42 of the guide rails 38 into the contact receiving cavity 24. The V-shaped portion 98 is then guided between the lead-in walls 84 of the contact 70, into the recess 88 between the walls, and into connection with the parallel walls 82 of the contact 70. The parallel walls 82 are flexible in order to ensure a good connection between the contact 70 and the lead-in 92.

The ground contact 96 comes into electrical contact with the ground wings 64 prior to the lead-in contact 92 coming into electrical contact with contact 70. This is a safety feature which prevents electrical shock from a premature flow of electricity through the burner.

The connector provides a means of ensuring that the leads of the surface burner are properly inserted and seated in the connector. Because the connector provides a smooth process for inserting the surface burner, the burner will sit on the stove top level and will not rattle on the stove top. By providing a guide member, the mating of the surface burner with the connector is much smoother and easier for the user to operate.

The electrical connector and contact of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An electrical connector, comprising:

a housing having a top, a front, a back, and a contact receiving cavity extending from the back to the front, the top being open to the cavity, and a guide rail extending along a top portion of the contact receiving cavity;

a contact disposed within the contact receiving cavity and having a contact section which is accessible through the open top of the housing; and a ground member disposed around the housing and having a connection section for making ground connection with a matable contact and having a mounting section for mounting the connector;

whereby the guide rail guides the matable contact through the open top and into proper mating with the contact.

2. The electrical connector of claim 1, wherein the housing has a mounting portion extending upwardly from the top of the housing, the mounting portion having a first latching surface.

3. The electrical connector of claim 2, wherein the grounding member has a top portion with a mounting tab, sidewalls which extend downwardly and forwardly from the top portion, the sidewalls have openings for receiving the latching surfaces and securing the ground member to the housing, front tabs, and wings extending from the sidewalls forming the connection section.

4. The electrical connector of claim 2, wherein the contact receiving cavity is open to the top of the housing from the front of the housing to the mounting portion, the mounting portion having stops disposed in alignment with the guide rails, the stops being recesses in the mounting portion.

5. The electrical connector of claim 2, wherein the guide rail comprises a flat surface on which the matable contact is guided at an angled, lead-in surface for directing the matable contact into electrical contact with the contact disposed within the housing.

6. The electrical connector of claim 2, wherein the contact receiving cavity includes second latching surfaces for preventing the contact from backing out of the housing, and stops disposed along the front of the housing to prevent the contact from moving out of the front of the housing.

7. The electrical connector of claim 1, wherein the contact comprises a crimping section and a mating section, the mating section having a front end and a back end, the mating section being generally U-shaped and having a base with generally parallel arms upstanding from the base, the upstanding arms having outwardly angled sections to guide a matable contact into electrical connection therewith.

8. The electrical connector of claim 7, wherein the contact includes a resilient latching arm for securing the contact within the cavity.

9. The electrical connector of claim 7, wherein the upstanding walls form a contact recess for receiving the matable contact therebetween.

10. The electrical connector of claim 9, wherein the contact recess extends longitudinally along the length of the contact.

11. The electrical connector of claim 3, wherein the wings of the ground member extend above the top of the housing, thereby allowing ground connection to occur prior to electrical connection with live contacts.

12. The electrical connector of claim 5, wherein the guide rail has a flat bottom surface which prevents the contact from moving upwardly out of the contact receiving cavity.

13. A contact for an electrical connector, comprising:

a main body extending in a longitudinal direction, the main body having a crimping section and a contact section, the contact section having a front end, a back end, and a top end, the contact section being generally U-shaped and having a base with generally parallel walls upstanding from the base, the upstanding walls having outwardly angled sections along the top end of the contact section to receive a matable contact therebetween and to guide the matable contact into connection with the parallel walls.

14. The contact of claim 13, wherein the upstanding walls forming a recess for receiving the contact therein, the recess extends longitudinally along the length of the contact.

15. The contact of claim 13, further comprising a resilient arm for securing the contact within the connector.

* * * * *